United States Patent [19]

Ikemoto

[11] Patent Number: 5,029,764

[45] Date of Patent: Jul. 9, 1991

[54] DOFFING CONTROL SYSTEM OF AN AUTOMATIC WINDER

[75] Inventor: Tomonari Ikemoto, Uji, Japan

[73] Assignee: Murata Kikai Kabushiki Kaisha, Kyoto, Japan

[21] Appl. No.: 402,060

[22] Filed: Sep. 1, 1989

[30] Foreign Application Priority Data

Sep. 2, 1988 [JP] Japan ..... 63-218485

[51] Int. Cl.[5] ..... B65H 67/04

[52] U.S. Cl. ..... 242/35.5 A; 242/36

[58] Field of Search ..... 242/35.5 R, 35.5 A, 242/36; 57/261, 263, 266, 268, 270, 271

[56] References Cited

U.S. PATENT DOCUMENTS 4,610,405 9/1986 Noshi ..... 242/35.5 A

*Primary Examiner*—Stanley N. Gilreath

*Attorney, Agent, or Firm*—Spensley, Horn, Jubas & Lubitz

[57] ABSTRACT

A doffing control system for an automatic winder. An automatic doffing device is reciprocated along each spindle of the automatic winder to effect doffing. At least two zones are defined along the spindles of the automatic winder in which at least two kinds of packages may be formed. A marker is provided at the boundary between the zones. A detector for detecting the marker is provided on the automatic doffing device. The automatic doffing device can discriminate between the two zones, and can recognize the number of packages doffed in each zone. A set number of packages doffed in each zone can be delivered.

9 Claims, 3 Drawing Sheets

DOFFING CONTROL SYSTEM OF AN AUTOMATIC WINDER

BACKGROUND OF THE INVENTION

1. Field of the Invention

The present invention relates to a doffing control system, and more particularly to a doffing control system of an automatic winder which enables a desired number of a variety of different kinds of packages to be doffed.

2. Description of Related Art

Automatic winders generally have a number of winding units arranged in an array. A package is fully wound to a set amount and is subjected to automatic doffing. The doffed fully wound package is transferred onto a conveyor provided at the back of the unit for delivery.

Such systems have heretofore been unable to perform automatic doffing of a first quantity of a first type of package and a second quantity of a second type of package. It has heretofore been necessary to actuate a package conveyor and a package shutter every time by a timer. Therefore, apparatus for stocking packages of different types has been required. The desired number of packages of the first type and the desired number of packages of the second type must be taken out of the apparatus and packed into cases. In conventional doffing control systems for automatic winders, it has not been possible to doff the required number of packages of different types in one and the same system.

It is an object of the present invention to provide a doffing control system of an automatic winder which enables the desired number of packages of various types to be doffed in a system in which yarns of many types are wound by the winder.

SUMMARY OF THE INVENTION

In accordance with an embodiment of the present invention, this and other objectives are achieved by providing a doffing control system for an automatic winder provided with an automatic doffing device which is reciprocated along each spindle of the automatic winder to effect doffing. At least two zones are defined along the spindles of the automatic winder. The winding units in the first of the two zones operate to produce a first type of package. The winding units in the second of the two zones operate to produce a second type of package. A marker means is provided at the boundary between the zones. The marker means may be formed, for example, from a magnet positioned at the boundary between the two zones. Detection means for detecting the marker means is provided on the automatic doffing device. The detection means may be formed, for example, from a reed switch provided on the automatic doffing device.

When the automatic doffing device is reciprocated along each spindle provided on the automatic winder, the detection means can detect the marker means at the boundary between the two zones. Accordingly, the automatic doffing device can discriminate between the two zones, and therefore can recognize the number of packages doffed in each zone. A set number of packages doffed in each zone can be delivered.

BRIEF DESCRIPTION OF THE DRAWINGS

A detailed description of a preferred embodiment of the invention will be made with reference to the accompanying drawings.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention. The scope of the invention is best defined by the appended claims.

Figure 1:
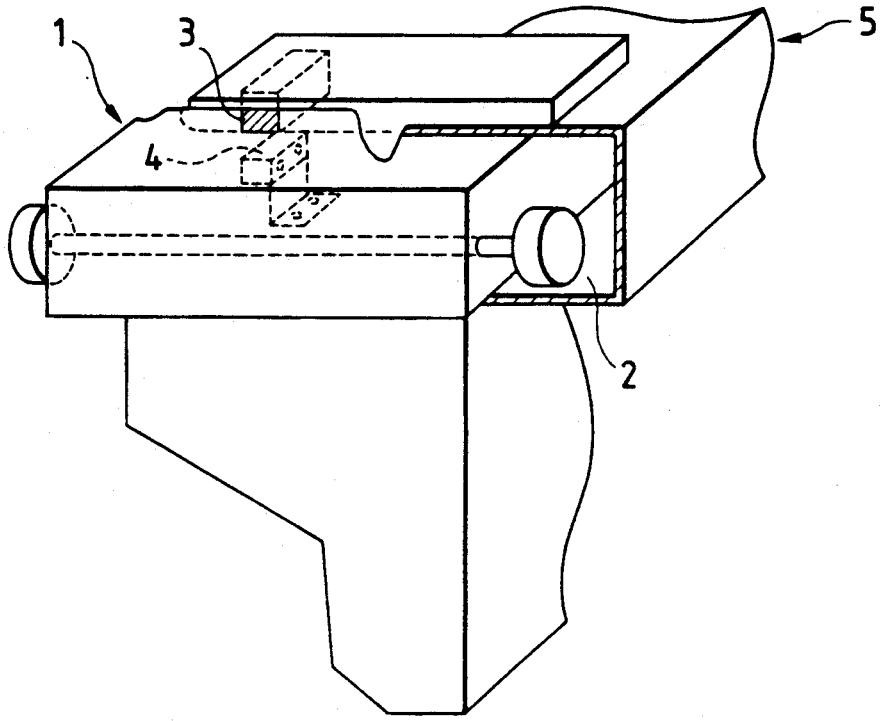
FIG. 1 shows a schematic perspective view illustrating a portion of one embodiment of the present invention.

As illustrated in FIG. 1, an automatic doffing device 1 reciprocates on the track 2 along each spindle of an automatic winder 5. The automatic winder 5 is provided with a magnet 3. The magnet 3 acts as a marker means and is positioned at a point on the track 2 which coincides with the boundary between two zones. A reed switch 4 mounted on the automatic doffing device 1 acts as a detection means for detecting the magnetic signal issued by the magnet 3.

The construction of the automatic winder 5 is described with reference to FIG. 2.

Figure 2:
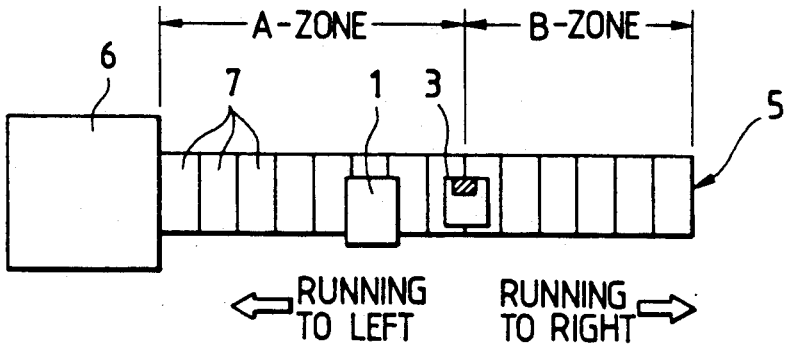
FIG. 2 shows a schematic view of the zones in an embodiment of an automatic winder.

In FIG. 2, reference numeral 7 designates winding units provided on respective spindles. Yarn on a spinning bobbin is rewound by each of the winding units 7 to form a package. The automatic doffing device 1 reciprocates along each of the spindles.

Each of the winding units 7 and the automatic doffing device 1 are controlled by a control device 6. The control device 6 controls the winding of packages at each of the winding units 7, detects a full winding, controls the travel of the automatic doffing device 1 and the doffing operation.

In the automatic winder 5 illustrated in FIG. 2, the winding units to the left of a certain spindle are designated as zone A, while the winding units to the right of that spindle are designated as zone B. In a case in which packages of different types are formed in zones A and B, a marker means in the form of a magnet 3 is provided on the boundary between zones A and B. A reed switch 4 which acts as the detection means for detecting the magnet 3 is provided o the automatic doffing device 1.

As shown in FIG. 2, the automatic doffing device 1 reciprocates to the left and to the right along the spindles 7 of the automatic winder 5. An automatic doffing device 1 initially positioned in the zone A will eventually travel rightward and pass across the boundary between the zone A and the zone B. The reed switch 4 provided on the automatic doffing device 1 will be turned ON by the action of the magnetic force of the magnet 3. This signal will be provided as an input to the control device 6, which may then use this input signal to determine that the automatic doffing device 1 has moved from the zone A to the zone B.

When the determination of zones becomes possible as described above, doffing the packages of different types according to the zones can be performed.

Figure 3:
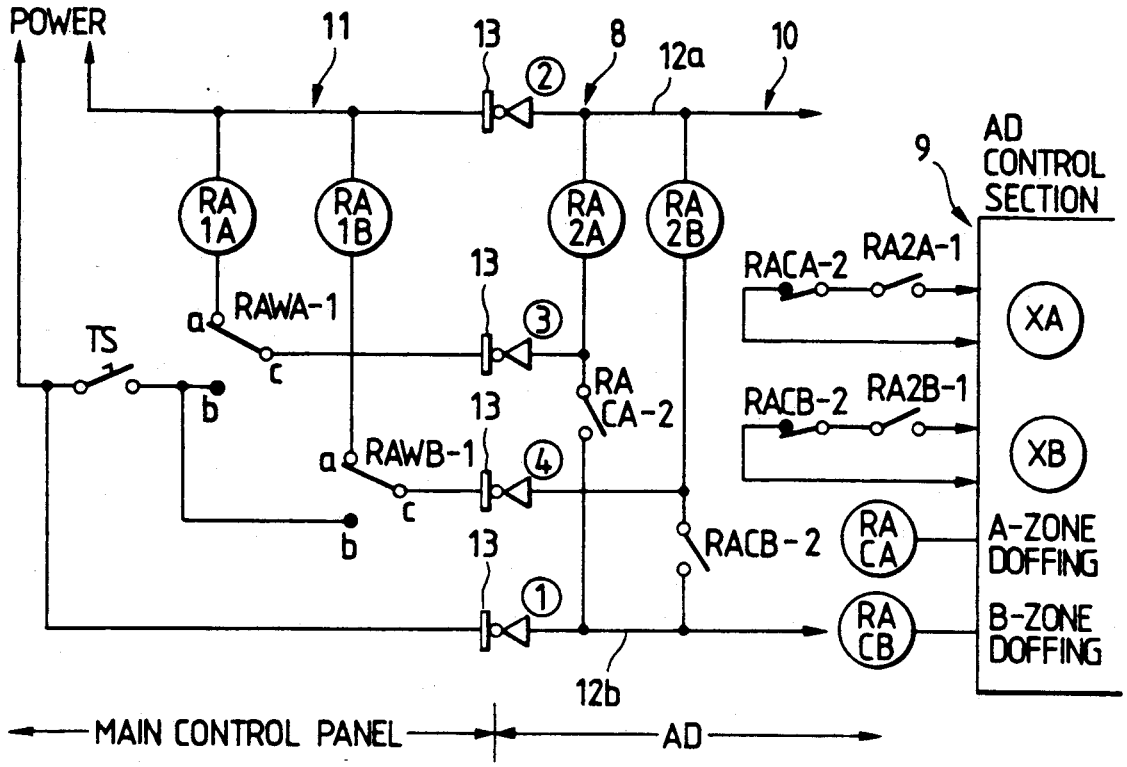
FIG. 3 shows a circuit for use in one embodiment of the present invention.

A control circuit 8 for the automatic doffing device 1 and the control device 6 is shown in FIG. 3. As shown in FIG. 3, the control circuit 8 comprises a control section 9 for the automatic doffing device (AD), an automatic doffing device section 10 and a body or main control panel 11.

Incorporated in the AD control section 9 are two relays: RACA and RACB. The relay RACA is excited when doffing is effected in zone A. The relay RACB is excited when doffing is effected in zone B.

In a signal input region in which doffing in zone A is inhibited, a b-contact RACA-1 of the relay RACA and an a-contact RA2A-1 of the relay RA2A are connected in series, and a b-contact RACB-1 of the relay RACB and an a-contact RA2B-1 of the relay RA2B are connected in series.

In the automatic doffing device section 10, a relay RA2A excited when doffing is inhibited in zone A and a relay RA2B excited when doffing is inhibited in zone B are connected to bus lines 12*a* and 12*b* through an a-contact RACA-2 of the relay RACA and an a-contact RACB-2 of the relay RACB.

In the main control panel 11, a switch TS for operating the present system and a relay RA1A (intermittently excited by every doffing in the zone A) are connected to a dipole contact RAWA-1 of the relay RAWA. A relay RA1B (intermittently excited by every doffing in the zone B) is connected to a dipole contact RAWB-1 of the relay RAWB.

A trolley 13 is provided at the boundary between the automatic doffing device section 10 and the main control panel 11.

Figure 4:
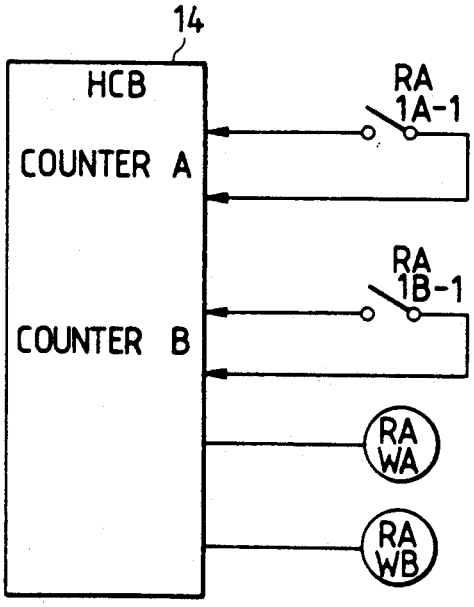
FIG. 4 shows a circuit relating to counting for use in one embodiment of the present invention.

As shown in FIG. 4, a carrier control board 14 is provided with a counter function for counting the number of doffings in the zones A and B. A contact RA1A-1 of the relay RA1A is connected to a counter A. A contact RA1B-1 of the relay RA1B is connected to a counter B. A relay RAWA which assumes an OFF state when the counter A reaches a predetermined number and a relay RAWB which assumes an OFF state when the counter B reaches a predetermined number are connected.

The operation of the foregoing embodiment will now be described. In the example which follows, it is assumed that the desired number of packages of type A to be doffed in zone A is equal to m and that the desired number of packages of type B to be doffed in zone B is equal to n.

First, the switch TS for operating the present system is turned ON. When a package is doffed in zone A, the relay RACA is excited. The b-contact RACA-1 is opened. At the same time, the a-contact RACA-2 is closed and then immediately opened. When the a-contact RACA-2 is closed, the relay RA1A is excited and the contact RA1A-1 is closed. At that time, the counter A counts 1. After counting, the a-contact RACA-2 is opened and the contact RA1A-1 is also opened. The remaining number of packages of type A is then m-1.

When a package is doffed in zone B, the relay RACB is excited. The b-contact RACB-1 is opened. At the same time the a-contact RACB-2 is closed and then immediately opened. When the a-contact RACB-2 is closed, the relay RA1B is excited and the contact RA1B-1 is closed. At that time, the counter B counts 1. After counting, the a-contact RACB-2 is opened and the contact RA1B-1 is also opened. The remaining number of packages of type B is then n-1.

In this manner, the counter A counts one every time a package is doffed in zone A, and the counter B counts one every time a package is doffed in zone B. When the counter A counts a predetermined number of times (in this example, the predetermined number of times is equal to m), the relay RAWA is deenergized to render the relay RAWA in the OFF state. At that time, the remaining number of packages of type A is equal to zero. Then, the dipole contact RAWA-1 is switched to the contact-b. At that time, the relay RA2A is excited to close the contact RA2A-1. The AD control section 9 controls to inhibit doffing in the zone A.

When the counter B counts a predetermined number of times (in this example, the predetermined number of times is equal to n), the relay RAWB is deenergized and the relay RAWB assumes an OFF state. At that time, the remaining number of packages of type B is equal to zero. Then, the dipole contact RAWB-1 is switched to the contact-b. At this time, the relay RA2B is excited to close the contact RA2B. The AD control section 9 controls to inhibit doffing in the zone B.

Figure 5:
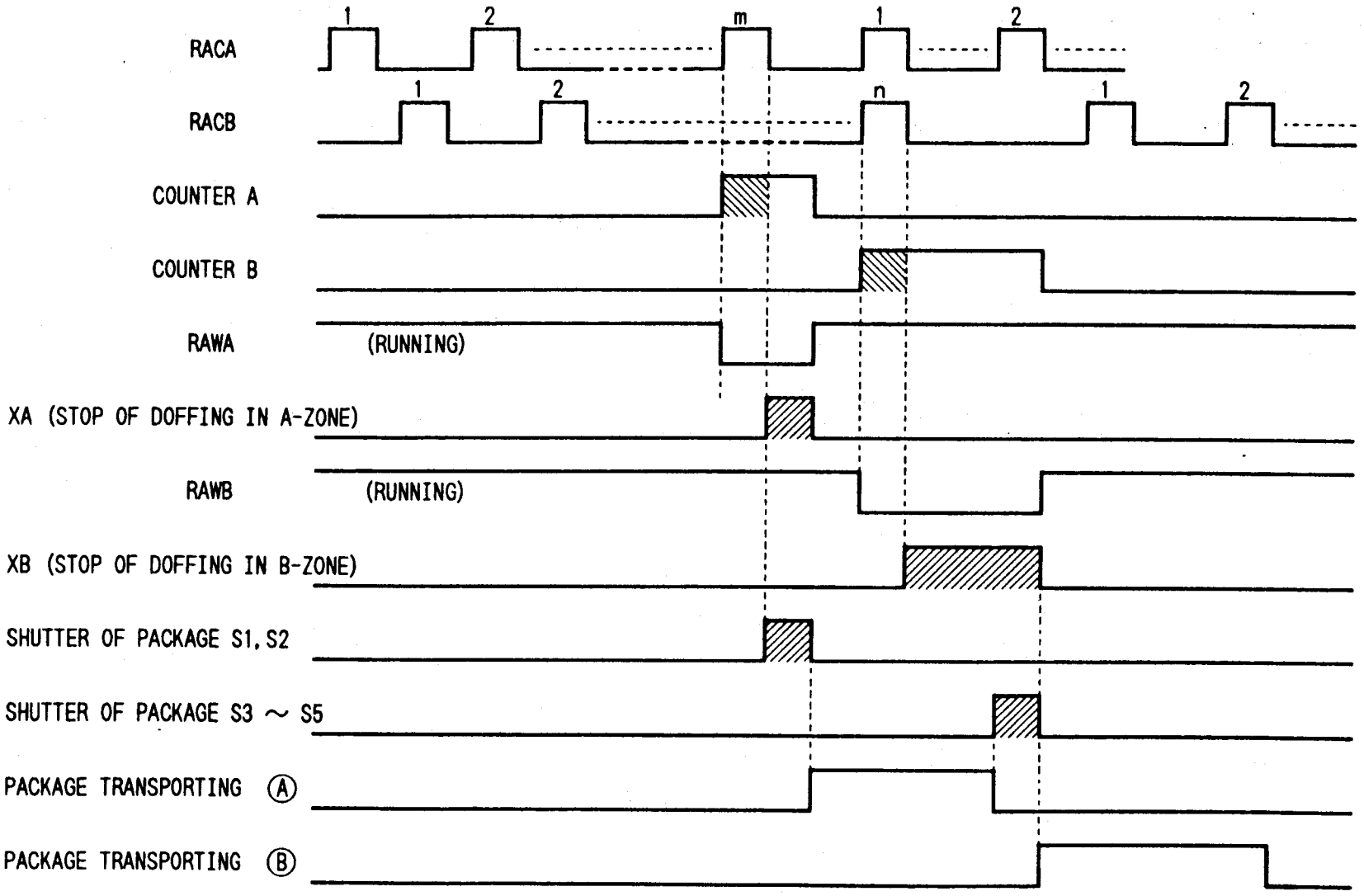
FIG. 5 shows a time chart of one embodiment according to the present invention.

FIG. 5 is a time chart showing the above-described operation.

As shown in FIG. 5, the relay RACA is turned ON intermittently every time a package of type A is doffed in the zone A. If m number of packages are doffed in the A zone, then the relay RACA is intermittently turned ON m number of times. At the doffing of package number m, the counter A is in the ON state, whereas the relay RAWA is in the OFF state. At that time, doffing in the zone A is inhibited. At the same time, package shutters S1 and S2 are opened. Thereafter, the inhibition state of doffing in the zone A is released, and the package shutters S1 and S2 are closed so that the package is carried and a signal indicative of packages being carried is issued.

The relay RACB is turned ON intermittently every time a package of type B is doffed in the zone B. If n number of packages are doffed in the B zone, then the relay RACB is intermittently turned ON n number of times. At the doffing of package number n, the counter B is in the ON state whereas the relay RAWB assumes an OFF state. At this time, doffing is inhibited in the zone B. At the same time, the package shutters S3 to S5 are opened. Thereafter, the state of inhibiting doffing in the zone B is released, and the package shutters S3 to S5 are closed so that the packages are carried, and a signal indicative of packages being carried is issued. The package shutters are provided to stop the packages until the required number of packages are doffed during the carrying a predetermined number of packages.

In the disclosed embodiment of the present invention, the shutters S1 and S2 are provided in zone A, while the shutters S3 through S5 are provided in Zone B. An example of the type of shutters which may be used in conjunction with the present invention may be found in U.S. Pat. No. 4,541,578, which is incorporated herein by reference. In U.S. Pat. No. 4,541,578, the exemplary shutters are illustrated as elements 121.1 through 121.6 in FIG. 8.

As described above, according to the present invention, efficient automatic doffing can be carried out without the necessity of providing an extra stock line.

The presently disclosed embodiment is to be considered in all respects as illustrative and not restrictive, the scope of the invention being indicated by the appended claims, rather than the foregoing description, and all changes which come within the meaning and range of equivalency of the claims are therefore intended to be embraced therein.

I claim:

1. A doffing control system for an automatic winder having a plurality of winding units operable for winding packages, the doffing control system comprising:

a doffing device reciprocally moveable adjacent the winding units for doffing the packages;

a first plurality of the winding units defining a first zone for winding a first type of package;

a second plurality of the winding units defining a second zone for winding a second type of package;

marker means provided between the first zone and the second zone;

detection means associated with the doffing device for detecting the marker means and for determining which of the first and second zones the doffing device is adjacent in response to the detection of the marker means;

counting means, responsive to the determination of which zone the doffing device is adjacent and to the doffing of packages, for counting the number of packages doffed in the first zone and for counting the number of packages doffed in the second zone;

control means for inhibiting doffing of packages in the first zone when the counted number of packages doffed in the first zone equals a predetermined number; and control means for inhibiting doffing of packages in the second zone when the counted number of packages doffed in the second zone equals a predetermined number.

2. A doffing control system for a winder having a first plurality of winding units defining a first zone for winding packages and a second plurality of winding units defining a second zone for winding packages, the doffing control system comprising:

a package doffing device, moveable adjacent the winding units defining the first and second zones, for doffing packages wound by the winding units;

determining means associated with the doffing device for determining which of the first and second zones the doffing device is adjacent;

counting means, responsive to the determination of which zone the doffing device is adjacent and to the doffing of packages, for counting the number of packages doffed in the first zone and for counting the number of packages doffed in the second zone;

control means for inhibiting doffing of packages in the first zone when the counted number of packages doffed in the first zone equals a predetermined number; and control means for inhibiting doffing of packages in the second zone when the counted number of packages doffed in the second zone equals a predetermined number.

3. A doffing control system as claimed in claim 2, further comprising:

distinguishing means for distinguishing the first zone from the second zone;

wherein the determining means is responsive to the distinguishing means for determining which of the first and second zones the doffing device is adjacent.

4. A doffing control system as claimed in claim 2, further comprising:

marker means for distinguishing the first zone from the second zone;

wherein the determining means comprises a detector for detecting the marker means.

5. A doffing control system as claimed in claim 4, wherein a transition point is located between the first and second zones;

wherein the marker means is disposed at the transition point;

wherein the detector is disposed on the package doffing device to detect the marker means upon the package doffing device being moved adjacent the transition point; and wherein the doffing control system further comprises means for moving the package doffing device adjacent the winding units and the transition point.

6. A doffing control method for a winder having a plurality of winding units defining first and second zones for winding packages and a package doffing device moveable adjacent the winding units defining the first and second zones for doffing packages wound by the winding units, the method comprising the steps of:

moving the package doffing device adjacent the winding units defining the first and second zones;

determining which of the first and second zones the package doffing device is adjacent;

doffing packages wound by winding units of the first zone with the package doffing device;

counting the number of doffed packages wound by winding units of the first zone upon determining that the package doffing device is adjacent the first zone and upon doffing packages wound by winding units of the first zone; and inhibiting doffing of packages wound by winding units of the first zone upon the counted number of doffed packages wound by winding units of the first zone equalling a first predetermined number.

7. A doffing control method as claimed in claim 6, further comprising the steps of:

doffing packages wound by winding units of the second zone with the package doffing device;

counting the number of doffed packages wound by winding units of the second zone upon determining that the package doffing device is adjacent the second zone and upon doffing packages wound by winding units of the second zone; and inhibiting doffing of packages wound by winding units of the second zone upon the counted number of doffed packages wound by winding units of the second zone equalling a second predetermined number.

8. A doffing control method as claimed in claim 7, wherein a zone delineator is provided at a transition point of the first and second zones and wherein the step of determining comprises the step of detecting the zone delineator upon the package doffing device being moved adjacent the transition point.

9. A doffing control method as claimed in claim 6, wherein a zone delineator is provided at a transition point of the first and second zones and wherein the step of determining comprises the step of detecting the zone delineator upon the package doffing device being moved adjacent the transition point.

* * * * *